US012018879B2

(12) United States Patent
Alanis et al.

(10) Patent No.: US 12,018,879 B2
(45) Date of Patent: Jun. 25, 2024

(54) REFRIGERATOR APPLIANCE

(71) Applicant: WHIRLPOOL CORPORATION, Benton Harbor, MI (US)

(72) Inventors: Nancy Sofia Alanis, Monterrey (MX); Kapil Ayyawar, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 212 days.

(21) Appl. No.: 17/569,661

(22) Filed: Jan. 6, 2022

(65) Prior Publication Data

US 2023/0213260 A1 Jul. 6, 2023

(51) Int. Cl.
*F25C 5/20* (2018.01)

(52) U.S. Cl.
CPC ..... *F25C 5/22* (2018.01); *F25C 2400/10* (2013.01)

(58) Field of Classification Search
CPC ..... F25C 5/22; F25D 23/04; F25D 17/06
See application file for complete search history.

(56) References Cited

U.S. PATENT DOCUMENTS

| | | | | |
|---|---|---|---|---|
| 7,188,479 | B2 | 3/2007 | Anselmino et al. | |
| 8,464,549 | B2 | 6/2013 | Davis et al. | |
| 10,323,874 | B2 | 6/2019 | Mitchell | |
| 10,473,378 | B2 | 11/2019 | Lee et al. | |
| 2010/0251748 | A1 | 10/2010 | Park | |
| 2012/0313330 | A1 | 12/2012 | Scalf et al. | |
| 2017/0051966 | A1 | 2/2017 | Powell | |
| 2018/0224184 | A1* | 8/2018 | Mitchell | F25D 23/067 |
| 2021/0148627 | A1* | 5/2021 | Jeong | F25C 5/22 |
| 2021/0262718 | A1 | 8/2021 | Burlingham et al. | |
| 2022/0065521 | A1* | 3/2022 | Shivappa Thenehalli | F25D 17/065 |

* cited by examiner

*Primary Examiner* — Elizabeth J Martin
(74) *Attorney, Agent, or Firm* — Brooks Kushman P.C.

(57) ABSTRACT

A refrigerator includes a first air duct, a second air duct, a door, and a gasket. The door has an ice maker disposed therein. The door also has a third air duct disposed along an internal side panel. The third air duct defines inlet and outlet orifices configured to establish fluid communication between first and second air ducts and the ice maker, respectively. The gasket is overmolded onto the third air duct and is configured to from a seal along an interface between the third air duct and the first air duct, and along an interface between the third air duct and the second air duct.

20 Claims, 12 Drawing Sheets

REFRIGERATOR APPLIANCE

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator includes a cabinet, a first air duct, a second air duct, a door, a first gasket, and a second gasket. The cabinet defines an internal cavity. The first and second air ducts are disposed within the internal cavity. The door is secured to the cabinet. The door has an ice maker disposed thereon. The door has inlet and outlet air ducts that are configured to establish fluid communication between the first and second air ducts and the ice maker, respectively, when the door is in a closed position. The first gasket is overmolded onto the inlet air duct and is configured to from a first seal between the internal cavity and an interface between first air duct and the inlet air duct. The second gasket is overmolded onto the outlet air duct and is configured to from a second seal between the internal cavity and an interface between second air duct and the outlet air duct.

A refrigerator includes a first air duct, a second air duct, a door, and a gasket. The door has an ice maker disposed thereon. The door also has a third air duct disposed along an internal side panel of the door. The third air duct defines inlet and outlet orifices configured to establish fluid communication between first and second air ducts and the ice maker, respectively. The gasket is overmolded onto the third air duct and is configured to from a seal along an interface between the third air duct and the first air duct, and along an interface between the third air duct and the second air duct.

A refrigerator includes primary air ducts, a door, an ice maker, a secondary air duct, and a gasket. The door has an inner liner. The inner liner defines an internal space and an orifice providing access to the internal space. The ice maker is disposed within the internal space. The secondary air duct is disposed within the orifice. The secondary air duct defines inlet and outlet apertures configured to establish fluid communication between the primary air ducts and the internal space. The gasket is overmolded onto the secondary air duct and is configured to from a seal along an interface between secondary air duct and the primary air ducts.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
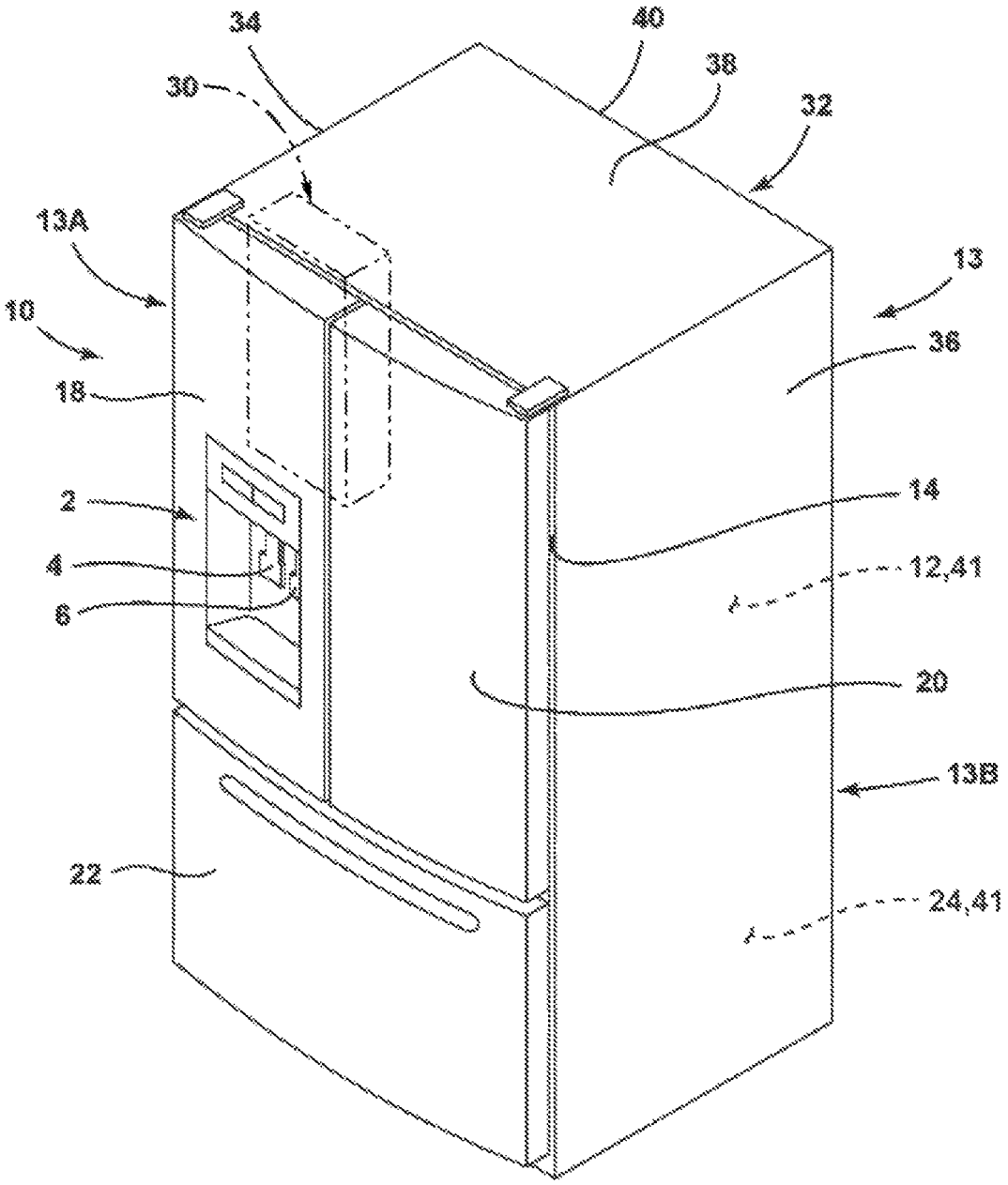
FIG. 1 is a top front perspective view of a refrigerator.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to the embodiment illustrated in FIG. 1, reference numeral 10 generally designates a refrigerator having a cabinet structure 13 with a front surface 14 opening into a refrigerator compartment 12. The cabinet structure 13 may include a vacuum insulated cabinet structure, as further described below. The refrigerator compartment 12 is contemplated to be an insulated portion of the cabinet structure 13 for storing fresh food items. First and second doors 18, 20 are rotatably coupled to the cabinet structure 13 near the front surface 14 thereof for selectively providing access to the refrigerator compartment 12 by pivoting movement between open and closed positions. In the embodiment shown in FIG. 1, a freezer drawer 22 is configured to selectively provide access to a freezer compartment 24 disposed below the refrigerator compartment 12. The refrigerator 10 shown in FIG. 1 is an exemplary embodiment of a refrigerator for use with the present concept, and is not meant to limit the scope of the present concept in any manner.

As further shown in FIG. 1, the first door 18 includes a dispensing station 2 which may include one or more paddles 4, 6 which are configured to initiate the dispensing of water and/or ice from outlets disposed within the dispensing station 2. In the embodiment shown in FIG. 1, the dispensing station 2 is shown as being accessible from outside of the refrigerator 10 on an exterior portion of the first door 18, but may also be provided along any portion of the refrigerator 10, including an interior of the refrigerator compartment 12, for dispensing ice and/or water. The dispensing station 2 is contemplated to be coupled to an ice maker 30 which is shown in phantom in FIG. 1. It is contemplated that the ice maker 30 may be operably coupled to the first door 18 to pivotally move with the first door 18 between open and closed positions. As further shown in FIG. 1, the cabinet structure 13 of the refrigerator 10 includes an exterior wrapper 32 which includes first and second sidewalls 34, 36, a top wall 38 and a rear wall 40. The exterior wrapper 32 is contemplated to be a metal component formed of a sheet metal material. The cabinet structure 13, or more specifically the exterior wrapper 32 of the cabinet structure 13, defines an internal cavity 41 that houses all of the internal components of the refrigerator 10. The refrigerator compartment 12 and the freezer compartment 24 may be considered to be portions of the internal cavity 41.

Figure 2:
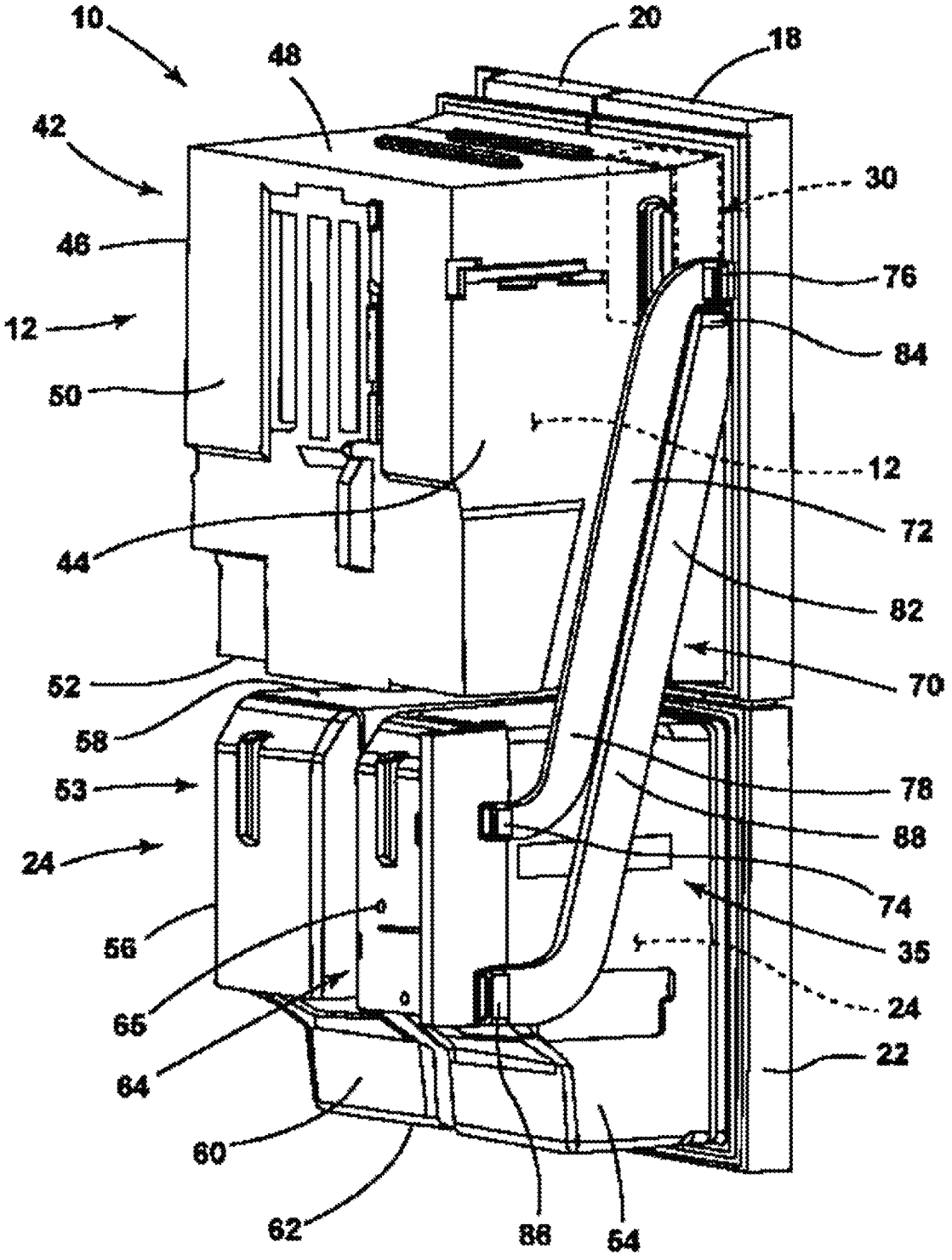
FIG. 2 is a top rear perspective view of the refrigerator of FIG. 1 with an exterior wrapper removed to reveal a refrigerator compartment, a freezer compartment, an ice maker, an evaporator housing and a duct assembly.

Referring now to FIG. 2, the refrigerator 10 is shown with the cabinet structure 13 removed to reveal the refrigerator compartment 12 disposed over the freezer compartment 24. The components illustrated in FIG. 2, other than the exterior facing portions of the doors 18, 20, are disposed within the internal cavity 41. The refrigerator compartment 12 is generally defined by a refrigerator liner 42 which includes first and second sidewalls 44, 46, a top wall 48, a rear wall 50 and a bottom wall 52. The freezer compartment 24 also includes a freezer liner 53 having first and second sidewalls 54, 56, a top wall 58, a rear wall 60 and a bottom wall 62. The refrigerator liner 42 and freezer liner 53 may be comprised of a sheet metal material or a polymeric material. As encapsulated by the exterior wrapper 32, the refrigerator liner 42 and the freezer liner 53 are spaced-apart from the exterior wrapper 32 to define an insulating space 66 (FIG. 4) therebetween, which may include a vacuum insulated space. Thus, the exterior wrapper 32 and the refrigerator liner 42 and freezer liner 53 may be interconnected by a trim breaker to define the overall cabinet structure 13 of the refrigerator 10.

Figure 3:
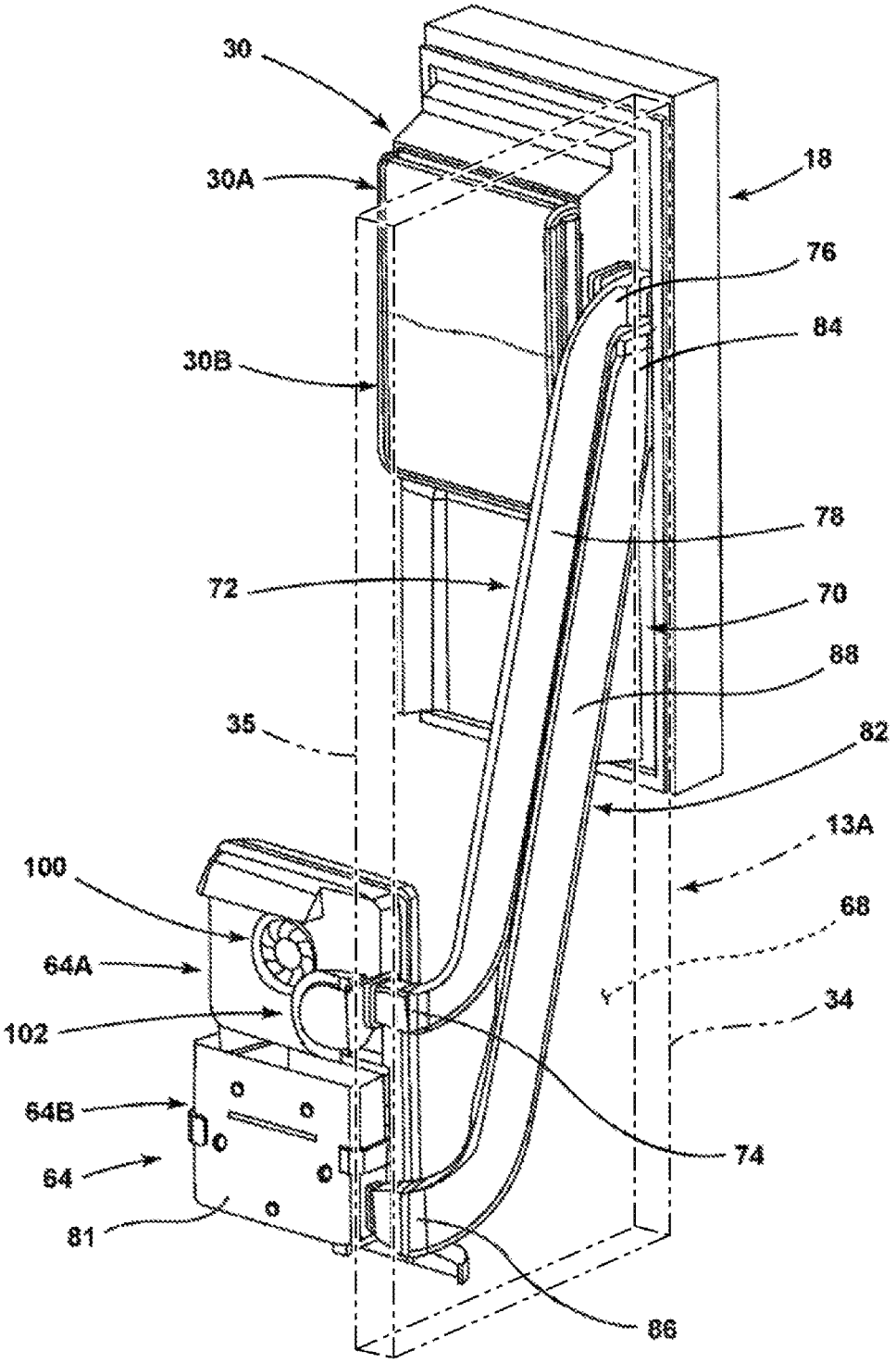
FIG. 3 is a top front perspective view of the duct assembly of FIG. 2 as coupled to the ice maker and disposed within a sidewall shown in phantom.
Figure 4:
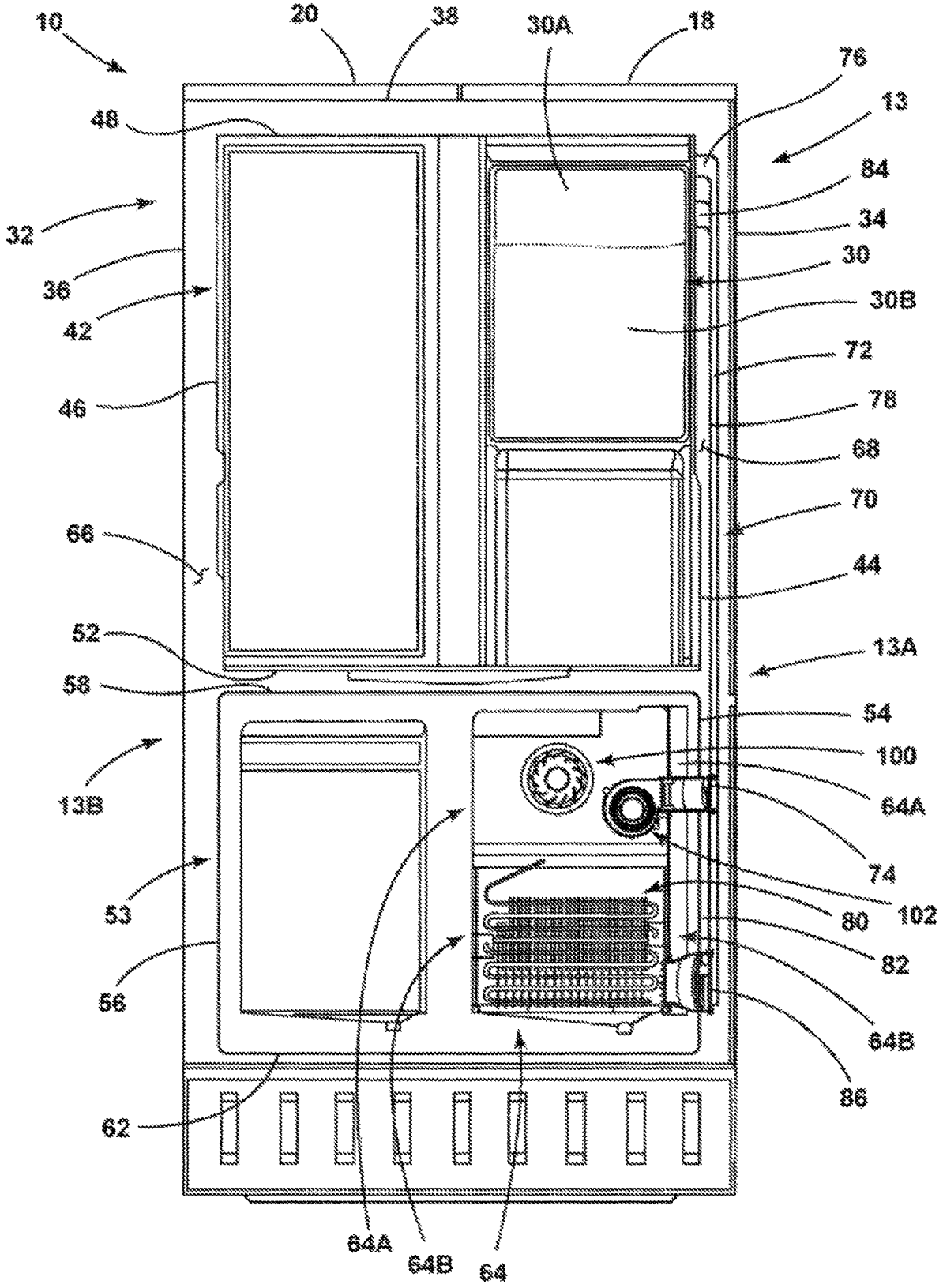
FIG. 4 is a rear elevation view of the refrigerator of FIG. 1 with a rear wall of the exterior wrapper removed.

With further reference to FIG. 1, the cabinet structure 13 includes first and second sidewalls 13A and 13B. The first sidewall 13A of the cabinet structure 13 is comprised of the first sidewall 34 of the exterior wrapper 32 as spaced-apart from the first sidewall 44 of the refrigerator liner 42 and the first sidewall 54 of the freezer liner 53. With the first sidewall 34 of the exterior wrapper 32 spaced-apart from the first sidewall 44 of the refrigerator liner 42 and spaced-apart from the first sidewall 54 of the freezer liner 53, an interior cavity 68 (FIGS. 3 and 4) of the first sidewall 13A is defined therebetween. The interior cavity 68 of the first sidewall 13A of the cabinet structure 13 is part of the internal cavity 41 and the insulating space 66 (FIG. 4) surrounding the refrigerator liner 42 and the freezer liner 53 and that is further surrounded or encapsulated by the exterior wrapper 32. It is contemplated that the second sidewall 13B is similarly formed on an opposite side of the cabinet structure 13 relative to the first sidewall 13A. In FIGS. 3 and 4 the combination of the first sidewall 44 of the refrigerator liner 42 and the first sidewall 54 of the freezer liner 53 is represented by reference numeral 35 for ease in defining the parameters of the first sidewall 13A of the cabinet structure 13.

With further reference to FIG. 2, an evaporator housing 64 is shown disposed on or adjacent to the rear wall 60 of the freezer liner 53. The evaporator housing 64 houses an evaporator 80 (FIG. 4) that provides cold air to the freezer compartment 24 and the ice maker 30. In FIG. 2, the evaporator 80 is concealed by an evaporator housing cover 65. It is contemplated that cold air may be drawn from the evaporator housing 64 for cooling the refrigerator compartment 12 as well. The first sidewall 13A (FIG. 1) is positioned on the same side of the cabinet structure 13 as the ice maker 30 and the evaporator housing 64. As positioned on this side of the cabinet structure 13, the interior cavity 68 of the first sidewall 13A houses a duct assembly 70 that interconnects the ice maker 30 and an evaporator housing 64. The duct assembly 70 is configured to be concealed within the interior cavity 68 of the first sidewall 13A, as best shown in FIG. 3. The duct assembly 70 includes an ice maker feed duct 72 having first and second ends 74, 76 with a body portion 78 disposed therebetween. The body portion 78 is a substantially linear body portion that defines an ascending airway between the evaporator housing 64 and the ice maker 30. The duct assembly 70 further includes an ice maker return duct 82. The ice maker return duct 82 includes a first end 84 coupled to the ice maker 30, and a second end 86 coupled to the evaporator housing 64. The ice maker return duct 82 further includes a body portion 88 disposed between the first and second ends 84, 86 that defines substantially linear descending airway between the ice maker 30 and the evaporator housing 64. The ice maker feed duct 72 and the ice maker return duct 82 may be referred to as first and second ducts, respectively, or vice versa. The ice maker feed duct 72 and the ice maker return duct 82 may also be referred to as primary ducts.

As used herein, the terms "substantial," "substantially," and variations thereof are intended to note that a described feature is equal or approximately equal to a value or description. For example, a "substantially linear" feature is intended to denote a feature that is linear or approximately linear. Moreover, "substantially" is intended to denote that two values are equal or approximately equal. In some embodiments, "substantially" may denote values within about 10% of each other, such as within about 5% of each other, or within about 2% of each other. As such, the substantially linear body portions 78, 88 of the ice maker feed duct 72 and the ice maker return duct 82, respectively, are contemplated to be substantially straight or linear body portions that interconnect the evaporator housing 64 with the ice maker 30 in a direct and un-convoluted manner.

Referring now to FIG. 3, the duct assembly 70 is shown disposed within the interior cavity 68 of the first sidewall 13A of the cabinet structure 13. As configured in FIG. 3, the ice maker feed duct 72 and the ice maker return duct 82 of the duct assembly 70 are entirely disposed within the interior cavity 68 of the first sidewall 13A of the cabinet structure 13. The first sidewall 13A is shown in phantom in FIG. 3 to better illustrate the position of the duct assembly 70 within the interior cavity 68 of the first sidewall 13A. Thus, the duct assembly 70, including ice maker feed duct 72 and the ice maker return duct 82, may be disposed within a single sidewall, the first sidewall 13A, of the cabinet structure 13. This configuration helps to directly feed cold air from the evaporator housing 64 to the ice maker 30. In FIG. 3, the evaporator housing cover 65 (FIG. 2) has been removed from the evaporator housing 64 to reveal first and second portions 64A, 64B of the evaporator housing 64. In the second portion 64B of the evaporator housing 64, the evaporator 80 (FIG. 4) is disposed and concealed in the view of FIG. 3 by an evaporator plate 81. In the first portion 64A of the evaporator housing 64, first and second fans 100, 102 are shown. The first fan 100 is configured to feed cold air to the freezer compartment 24 during a freezer compartment cooling cycle. As such, the first fan 100 may be referred to herein as a freezer compartment fan. The first fan 100 is connected in-series to the second fan 102, as further described below. Thus, the first fan 100 provides cold air not only to the freezer compartment 24, but also provides cold air from the evaporator 80 to the second fan 102 as well. The second fan 102 provides cold air from the first fan 100 to the ice maker 30 via the duct assembly 70 during an ice making cycle. As such, the second fan 102 may be referred to herein as an ice maker fan. Thus, the first and second fans 100, 102 are operable between active and at-rest conditions, wherein the fans 100, 102 are running in the active condition and are not running in the at-rest condition. The condition of the first and second fans 100, 102 is controlled by a controller of the refrigerator 10, as further described below, which also controls the various cycles of the refrigerator 10.

As further shown in FIG. 3, the ice maker 30 includes first and second portions 30A, 30B. As illustrated, the ice maker feed duct 72 is interconnected between the evaporator housing 64, at the first portion 64A thereof, at the first end 74 of the ice maker feed duct 72, and the ice maker 30, at the first portion 30A thereof, at the second end 76 of the ice maker feed duct 72. As further illustrated in FIG. 3, the ice maker return duct 82 is interconnected between the ice maker 30, at the second portion 30B thereof, at the first end 84 of the ice maker return duct 82, and evaporator housing 64, at the second portion 64B thereof, at the second end 86 of the ice maker return duct 82. Thus, it is contemplated that the second fan 102 supplies cold air from the evaporator housing 64 to the ice maker 30 via the ice maker feed duct 72 of the duct assembly 70. The cold air powered by the second fan 102 is fed into the first portion 30A of the ice maker 30 by the ice maker feed duct 72. It is contemplated that ice is made in the first portion 30A of the ice maker 30. Cold air remaining from the ice making process is returned to the second portion 64B of the evaporator housing 64 by the ice maker return duct 82 for recycling. In this way, the ice maker return duct 82 provides cold air to the evaporator housing 64 near the evaporator 80, such that the evaporator 80 can use the cold air leftover from an ice making process when providing cold air to the first fan 100. This results in an overall energy savings for the cold air producing process of the evaporator 80. Both the ice maker feed duct 72 and the ice maker return duct 82 are contemplated to be insulated ducts, as they are configured to carry much colder air as compared to cold air provided to the refrigerator compartment 12 (FIGS. 1-2). The ice maker feed duct 72 and the ice maker return duct 82 are contemplated to be insulated by a gas impervious barrier having an insulating material, such that the super cooled air carried in the ice maker feed duct 72 and the ice maker return duct 82 is not diffused into other components of the refrigerator 10 along the travel path between the evaporator housing 64 and the ice maker 30.

Referring now to FIG. 4, the duct assembly 70 is shown disposed within the interior cavity 68 of the first sidewall 13A of the cabinet structure 13. As configured in FIG. 4, the ice maker feed duct 72 and the ice maker return duct 82 of the duct assembly 70 are entirely disposed within the interior cavity 68 of the first sidewall 13A of the cabinet structure 13. Thus, as noted above, the duct assembly 70 is disposed entirely within the first sidewall 13A of the cabinet structure 13 given the narrow profile of the duct assembly 70. The ice maker feed duct 72 is positioned vertically above the ice maker return duct 82, such that in the view of FIG. 4, the ice maker return duct 82 is largely concealed by the ice maker feed duct 72. This vertical overlapping configuration of the ice maker feed duct 72 and the ice maker return duct 82 helps to keep the profile of the overall duct assembly 70 narrow for reception within the interior cavity 68 of the first sidewall 13A of the cabinet structure 13.

Figure 5:
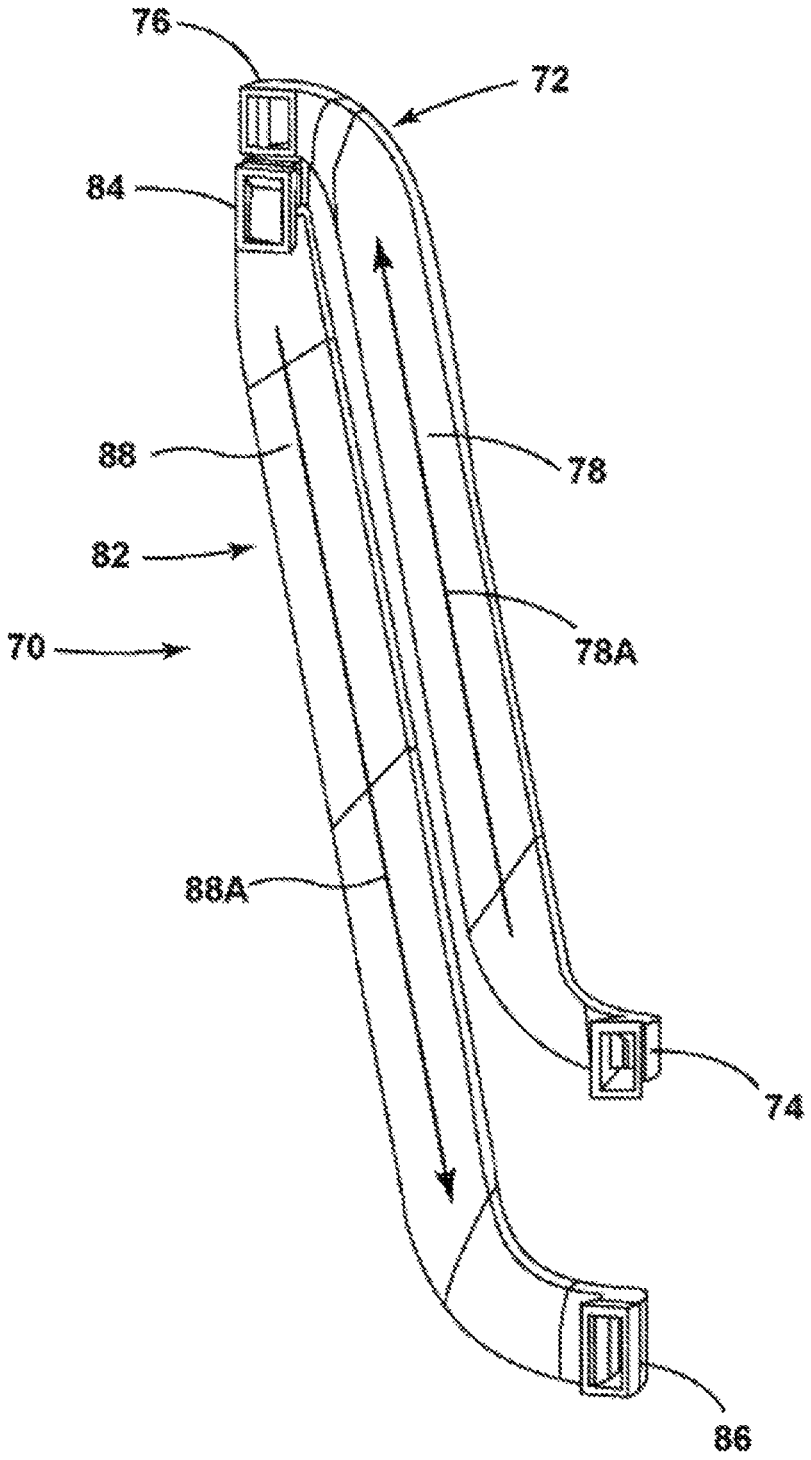
FIG. 5 is a side top perspective view of the duct assembly of FIG. 3.

Referring now to FIG. 5, the duct assembly 70 is shown with the ice maker feed duct 72 and the ice maker return duct 82 positioned with the respective body portions 78, 88 thereof in a substantially parallel relationship. As noted above, the ice maker feed duct 72 is positioned vertically above the ice maker return duct 82 in assembly. Also noted above, the respective body portions 78, 88 of the ice maker feed duct 72 and the ice maker return duct 82 are substantially linear to define direct has of airflow through the body portions 78, 88 as respectively indicated by arrows 78A, 88A. With specific reference to the ice maker feed duct 72, the body portion 78 thereof is an inclined body portion that upwardly ascends from the first end 74 to the second end 76 in a substantially linear manner. This inclined body portion 78 results in an inclined airflow, as indicated by arrow 78A, through the ice maker feed duct 72. With specific reference to the ice maker return duct 82, the body portion 88 thereof is an inclined body portion that downwardly ascends from the first end 84 to the second end 86 in a substantially linear manner. This inclined body portion 88 results in an inclined airflow, as indicated by arrow 88A, through the ice maker return duct 82. As used herein, the term "substantially linear" indicates that the body portions 78, 88 of the ice maker feed duct 72 and the ice maker return duct 82, respectively, are substantially straight or straight body portions that directly interconnect the evaporator housing 64 with the ice maker 30. As shown in FIG. 5, the first ends 74, 84 and the second ends 76, 86 include some curved portions that outwardly offset the body portions 78, 88, but the body portions 78, 88 themselves are substantially linear. As such, it is contemplated that the body portions 78, 88 of the ice maker feed duct 72 and the ice maker return duct 82, respectively, are 90% linear, 95% linear or more relative to the inclined portions of the body portions 78, 88 that are disposed within the interior cavity 68 of the first sidewall 13A of the cabinet structure 13, as shown in FIG. 3. Thus, the body portion 78 of the ice maker feed duct 72 defines a substantially linear ascending airway from the evaporator housing 64 to the ice maker 30. Similarly, the body portion 88 of the ice maker return duct 82 defines a substantially linear descending airway from the ice maker 30 to the evaporator housing 64. Thus, the inclined portion of the body portions 78, 88 of the ice maker feed duct 72 and ice maker return duct 82 are both linearly disposed within a single sidewall, the first sidewall 13A, of the cabinet structure 13.

The substantially linear ducts 72, 82 of the duct assembly 70 connects the source of cold air (the freezer evaporator 80) directly to the ice maker 30. This direct connection between the evaporator housing 64 and the ice maker 30 eliminates the need for door ducts which would introduce branching to the substantially linear duct design. In this way, the total length of the airways defined by the ice maker feed duct 72 and the ice maker return duct 82 going from the evaporator 80 to the ice maker 30 is greatly reduced. Also, the air resistance to reach the ice maker 30 is greatly reduced because cold air traveling along the airflow path indicated by arrow 78A does not have to turn in a torturous path from cabinet ducts to door ducts. As a result, the pressure drop across the ducts 72, 82 is reduced by more than 50% at the same airflow cfm rate. Due to lesser pressure drop across the ducts 72, 82, the pressure in the freezer compartment 24 increases from −0.04" of water to less than −0.02" of water. Thus, the infiltration inside freezer compartment 24 from the ambient air surrounding the same is greatly reduced due to reduction in negative pressure in the freezer compartment 24. With the current linear duct assembly 70, test results show no frost formation in the freezer compartment 24 at standard fan speeds. Frost formation is measured on the Leichert's Scale ranging from 0, which indicates a completely clean or frost free environment, to 7, which is indicates a frost accumulation of more than a four square inch area. Based on simulations conducted with standard ducts having indirect nonlinear pathways, an equation was created to predict the frost formation based on the Leichert's Scale. The results of the equation show the Leichert's Scale scale moving from a range of about 4-7 on the Leichert's Scale in the non-linear duct assemblies, to about 0-2 on the Leichert's Scale with the substantially linear ducts 72, 82 of the present concept.

Figure 6:
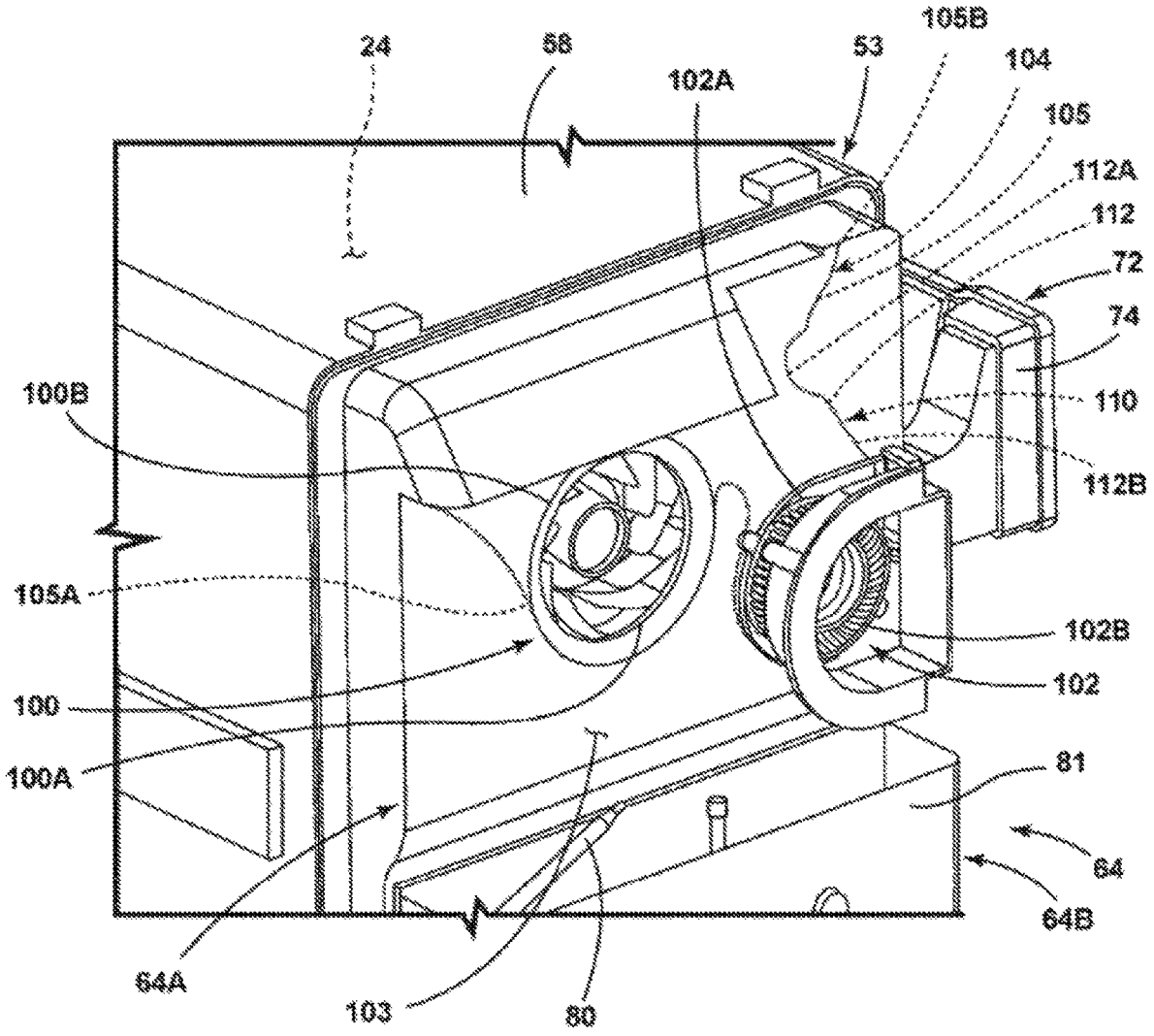
FIG. 6 is a top perspective view of the evaporator housing of FIG. 2.

Referring now to FIG. 6, the first fan 100 includes first and second sides 100A, 100B which respectively indicate intake and output sides of the first fan 100. Similarly, the second fan 102 includes first and second sides 102A, 102B which respectively indicate intake and output sides of the second fan 102. As noted above, the first and second fans 100, 102 are arranged in-series with the second side 100B of the first fan 100 being fluidically coupled to the first side 102A of the second fan 102 by an inlet 110. Specifically, the first side 100A of the first fan 100 opens into a spacing 103 that fluidically interconnects the first fan 100 and the evaporator 80 to provide cold air from the evaporator 80 to the first side 100A of the first fan 100. It is contemplated that the spacing 103 may be a direct duct member that interconnects the first fan 100 with the evaporator 80. It is also contemplated that the spacing 103 may be defined by the evaporator housing cover 65 (FIG. 2), such that the spacing 103 is an open spacing between the first side 100A of the first fan 100 and the evaporator 80. The second side 100B of the first fan 100 opens into an outlet 104 for providing cooled air to the freezer compartment 24. Specifically, the outlet 104 includes first and second ends 105A, 105B and a body portion 105 disposed between the first and second ends 105A, 105B. The first end 105A of the outlet 104 is fluidically coupled to the second side 100B of the first fan 100. The second end 105B of the outlet 104 opens into the freezer compartment 24 to fluidically interconnect the first fan 100 with the freezer compartment 24. As further shown in FIG. 6, the inlet 110 includes first and second ends 112A, 112B having a body portion 112 disposed therebetween. The first end 112A of the inlet 110 is fluidically coupled to the body portion 105 of the outlet 104. The second end 112B of the inlet 110 is fluidically coupled with the second fan 102 at the first side 102A of the second fan 102. As further shown in FIG. 6, the second side 102B of the second fan 102 is fluidically coupled to the first end 74 of the ice maker feed duct 72. Thus, the first and second fans 100, 102 are configured in-series wherein the first fan 100 is the only fan directly connected to the evaporator 80 through the spacing 103, and the second fan 102 is fluidically interconnected with the evaporator 80 only through the inlet 110 and outlet 104 with the first fan 100 disposed therebetween. Thus, the first fan 100 is the only fan that can draw cooled air from the evaporator 80 directly, as the second fan 102 is only coupled to the evaporator 80 through the first fan 100.

As used herein, the terms "fluidically coupled", "fluidically connected" or "fluidically interconnected" indicates that two or more structures are connected to one another in such a way as to provide for fluid airflow between the two or more structures. Said differently, an airway interconnects the two or more structures, such as the duct assembly 70 fluidically interconnecting the ice maker 30 and the evaporator housing 64. Also as used herein, the term "in-series" indicates two or more structures that are serially aligned along an airway, such as the first and second fans 100, 102.

Figure 7:
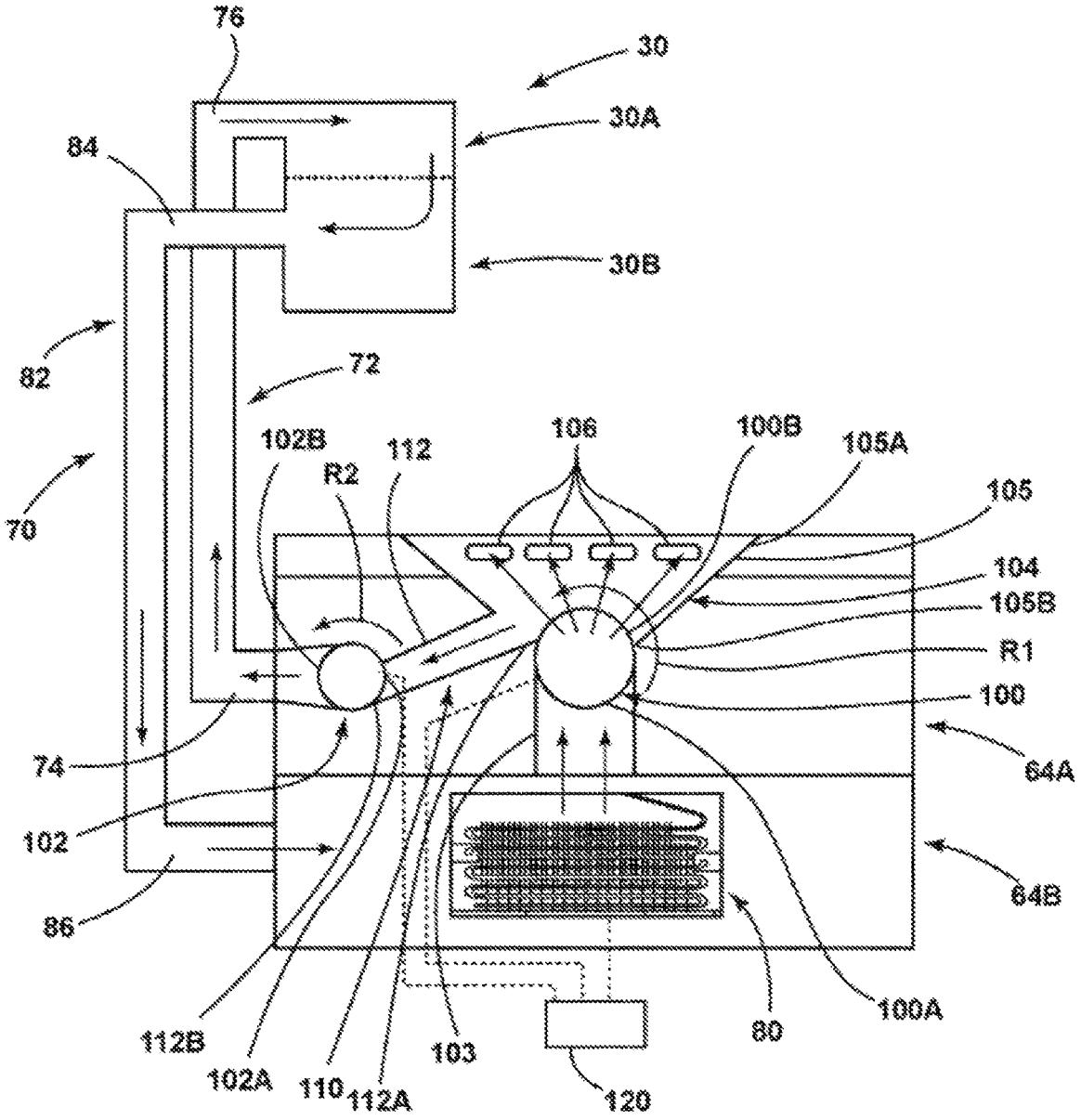
FIG. 7 is a schematic illustration of an evaporator housing connected to a freezer compartment and further connected to an icemaker via a duct assembly.

Referring now to FIG. 7, it is contemplated that a controller 120 for the refrigerator 10 is provided that controls both the first fan 100 and the second fan 102, such that they can run and oscillate between the active and at-rest conditions during distinct cooling cycles (i.e. a freezer compartment cooling cycle, and an ice making cycle). The controller 120 is shown in FIG. 7 as being operably coupled to the first and second fans 100, 102 and the evaporator 80, for controlling the same. Specifically, the first and second fans 100, 102 are controlled by the controller 120 between the active and at-rest conditions, while the evaporator 80 can be controlled by the controller 120 to provide various temperature levels of cold air as needed per a specific refrigerator cycle. It is consummated that the controller 120 can be positioned at any portion within the refrigerator 10, so long as the controller 120 is electronically coupled with the first and second fans 100, 102 and a compressor that is part of the refrigeration circuit that includes the evaporator 80. It is contemplated that the first fan 100 will be in the active condition and will run during a freezer compartment cooling cycle with cold air temperatures provided to the freezer compartment 24 at a first temperature level via the evaporator 80. It is contemplated that the second fan 102 will be in the at-rest condition and not run during the freezer compartment cooling cycle, so as not to unnecessarily draw air intended for the freezer compartment 24 to the ice maker 30. However, as noted above, the second fan 102 is fluidically coupled to the first fan 100 which is fluidically coupled to the evaporator 80. Thus, even when the second fan 102 is in the at-rest condition, cold air from the evaporator 80 will be propelled by the first fan 100 to not only the freezer compartment 24 via outlet 104, but cold air from the evaporator 80 will also be propelled by the first fan 100 to the inlet 110. As noted above, the inlet 110 is fluidically coupled to the second fan 102 which is fluidically coupled to the duct assembly 70 which is fluidically coupled to the ice maker 30. In this way, cold air from the evaporator 80 is provided to the ice maker 30 by the first fan 100 when the first fan 100 is in the active condition during a freezer compartment cooling cycle, even though the second fan 102 is in the at-rest condition. The cold air from the evaporator 80 is provided to the ice maker 30 by the first fan 100 during a freezer compartment cooling cycle a level sufficient to keep already formed and stored ice in the ice maker 30 from melting.

While illustrated as one controller, the controller 120 may be part of a larger control system and may be controlled by various other controllers throughout the refrigerator 10. It should therefore be understood that the controller 120 and one or more other controllers can collectively be referred to as a "controller" that controls various actuators in response to signals from various sensors to control functions the refrigerator 10 or refrigerator subsystems. The controller 120 may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller 120 in controlling the refrigerator 10 or refrigerator subsystems.

Control logic or functions performed by the 120 may be represented by flow charts or similar diagrams in one or more figures. These figures provide representative control strategies and/or logic that may be implemented using one or more processing strategies such as event-driven, interrupt-driven, multi-tasking, multi-threading, and the like. As such, various steps or functions illustrated may be performed in the sequence illustrated, in parallel, or in some cases omitted. Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for ease of illustration and description. The control logic may be implemented primarily in software executed by a microprocessor-based controller, such as controller 120. Of course, the control logic may be implemented in software, hardware, or a combination of software and hardware in one or more controllers depending upon the particular application. When implemented in software, the control logic may be provided in one or more computer-readable storage devices or media having stored data representing code or instructions executed by a computer to control the refrigerator 10 or its subsystems. The computer-readable storage devices or media may include one or more of a number of known physical devices which utilize electric, magnetic, and/or optical storage to keep executable instructions and associated calibration information, operating variables, and the like.

Further, it is contemplated that the second fan 102 will be in the active condition and will run during an ice making cycle with temperatures provided at a second temperature level via the evaporator 80. It is contemplated that the second temperature level of cold air provided by the evaporator 80 is less than the first temperature level. The second temperature level is contemplated to be a temperature level below freezing to provide appropriate temperatures of cooled air for making ice in the ice maker 30. It is contemplated that the first fan 100 will also be in the active condition and will run during the ice making cycle along with the second fan 102. As the first fan 100 and the second fan 102 are connected in-series, the first fan 100 will assist the second fan 102 in providing cooled air to the ice maker 30, rather than having the first fan 100 compete with the second fan 102 for cooled air from the evaporator 80.

With further reference to FIG. 7, the first fan 100 is configured for rotation along the path as indicated by arrow R1 when the first fan 100 is in the active condition. Similarly, the second fan 102 is configured for rotation along the path as indicated by arrow R2 when the second fan 102 is in the active condition. As noted above, the first and second fans 100, 102 are arranged in-series with the second side 100B of the first fan 100 being fluidically coupled to the first side 102A of the second fan 102 by the inlet 110, as shown in FIG. 6. In the schematic view of FIG. 7, the first fan 100 opens into the spacing 103 that fluidically interconnects the first fan 100 with the evaporator 80 to provide cold air from the evaporator 80 to the first fan 100. The first fan 100 directs cold air from the evaporator 80 into the outlet 104 for providing cooled air to the freezer compartment 24 via venting apertures 106 that are contemplated to open into the freezer compartment 24 to fluidically interconnect the first fan 100 with the freezer compartment 24. The body portion 105 of the outlet 104 is further coupled, in a fluidic manner, to the first end 112A of the inlet 110. As noted above, and shown schematically in FIG. 7, the second end 112B of the inlet 110 is fluidically coupled with the second fan 102. While only the first fan 100 is fluidically coupled to the evaporator 80 in a direct manner, cold air from the evaporator 80 is provided to the ice maker 30 during a freezer compartment cooling cycle of the refrigerator 10. Relative airflow to the freezer compartment 24 is indicated in FIG. 7 by the four arrows emanating from the first fan 100 towards the venting apertures 106 within the outlet 104. Further, relative airflow to the inlet 110 is indicated in FIG. 7 by the arrow emanating from the first fan 100 towards the inlet 110. Thus, a majority of the cold air from the evaporator 80 is provided to the freezer compartment 24 during a freezer compartment cooling cycle of the refrigerator 10 as powered by the first fan 100 alone. A smaller portion of cold air is provided to the ice maker 30 through the inlet 110 in the duct assembly 70 during the freezer compartment cooling cycle as powered by the first fan 100 in the active condition, even when the second fan 102 is in the at-rest condition. As noted above, this portion of cold air provided by the first fan 100 to the ice maker 30 during a freezer compartment cooling cycle is enough to keep ice stored in the ice maker 30 from melting.

Figure 8:
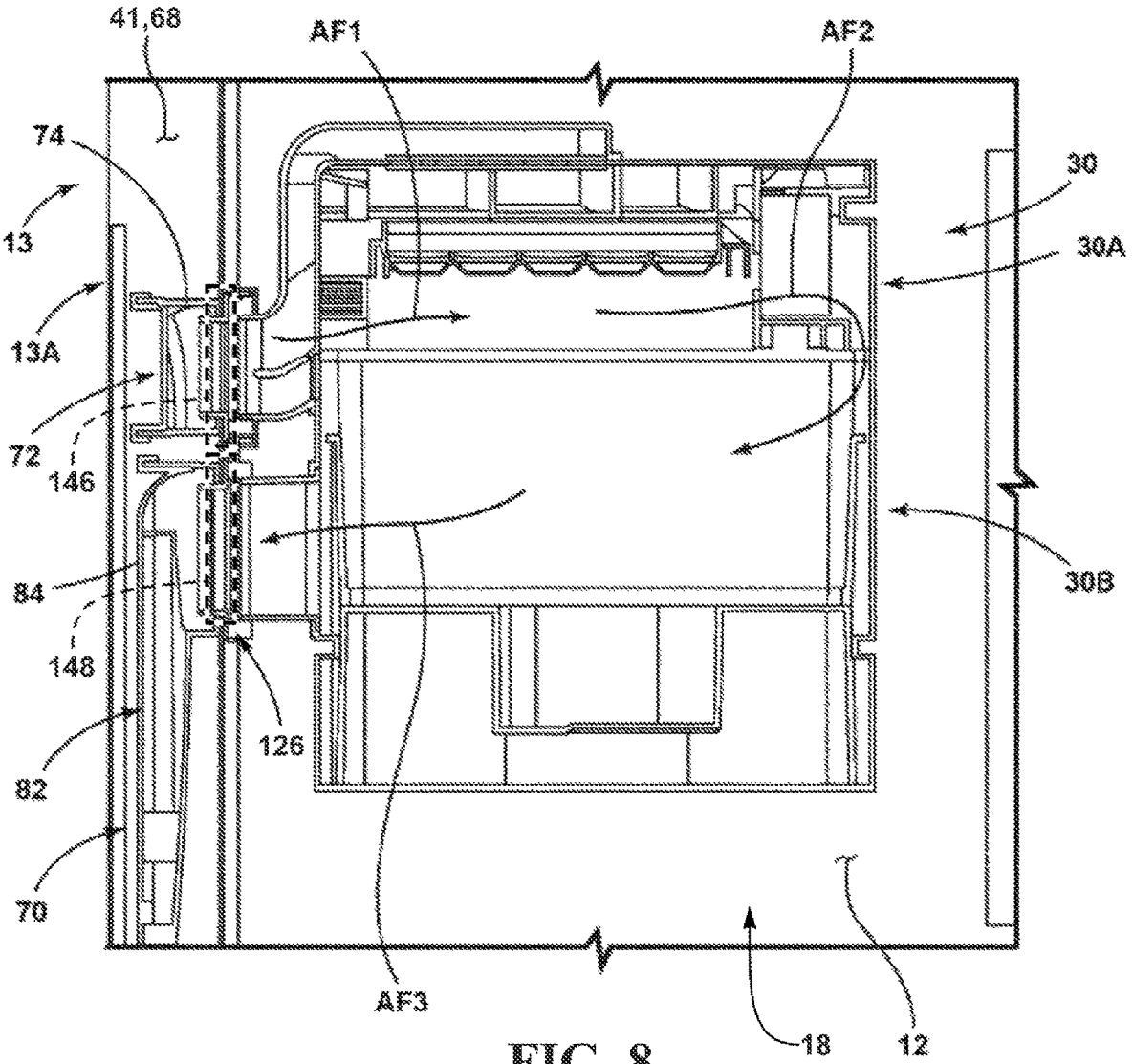
FIG. 8 is a front elevation view of the ice maker of FIG. 3.

Referring now to FIG. 8, the ice maker 30 is shown with the first end 74 of the ice maker feed duct 72 shown feeding cold air into the first portion 30A of the ice maker 30 along an airflow path as indicated by arrow AF1. The cold air provided to the first portion 30A of the ice maker 30 via the ice maker feed duct 72 is used to create ice within the ice maker 30. Cold air then travels from the first portion 30A of the ice maker 30 to the second portion 30B of the ice maker 30 along the airflow path indicated by arrow AF2. Cold air then exits the second portion 30B of the ice maker 30 along the airflow path indicated by arrow AF3 to return to the evaporator housing 64 for recycling via the ice maker return duct 82.

Figure 9:
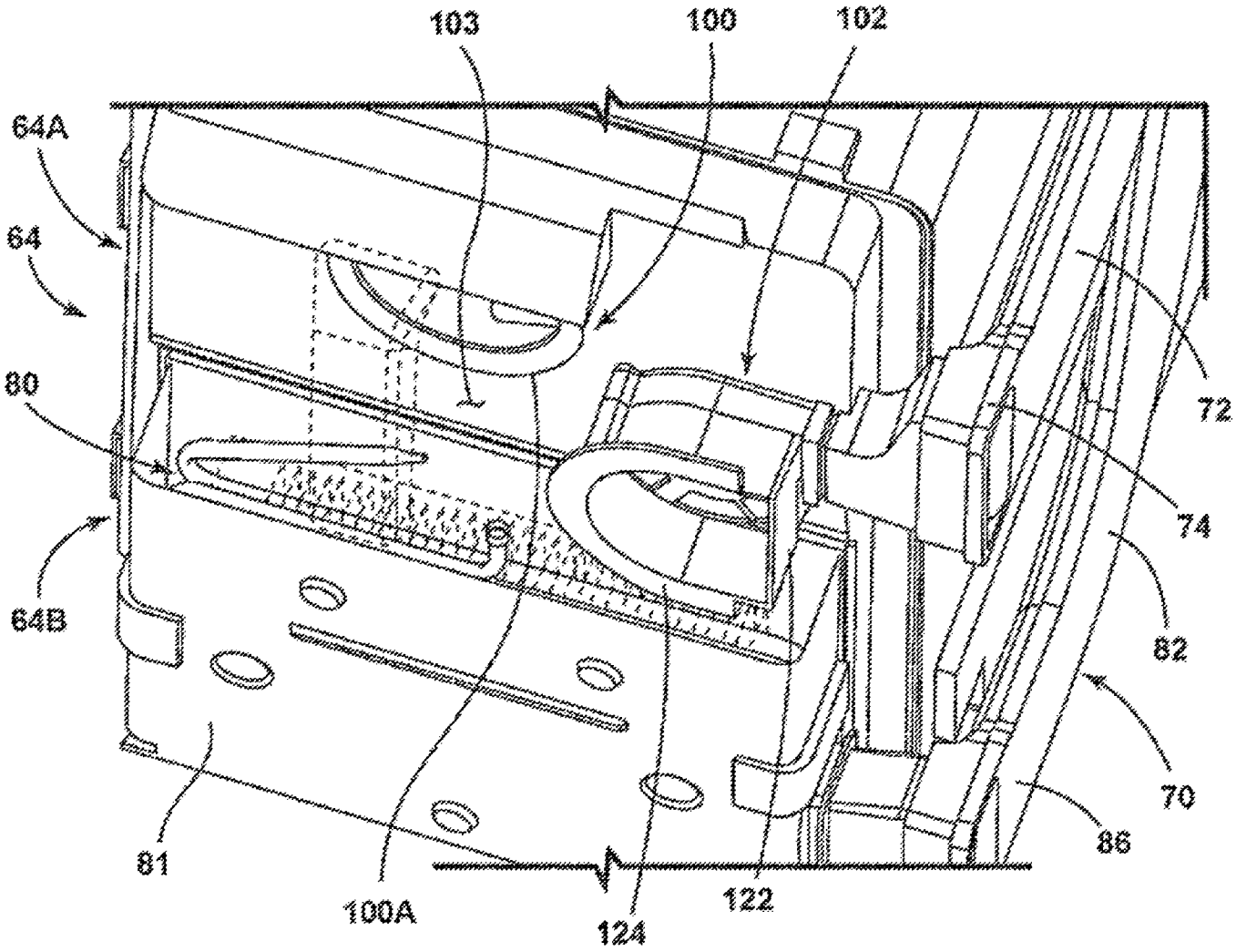
FIG. 9 is a top perspective view of the evaporator housing of FIG. 6.
Figure 10:
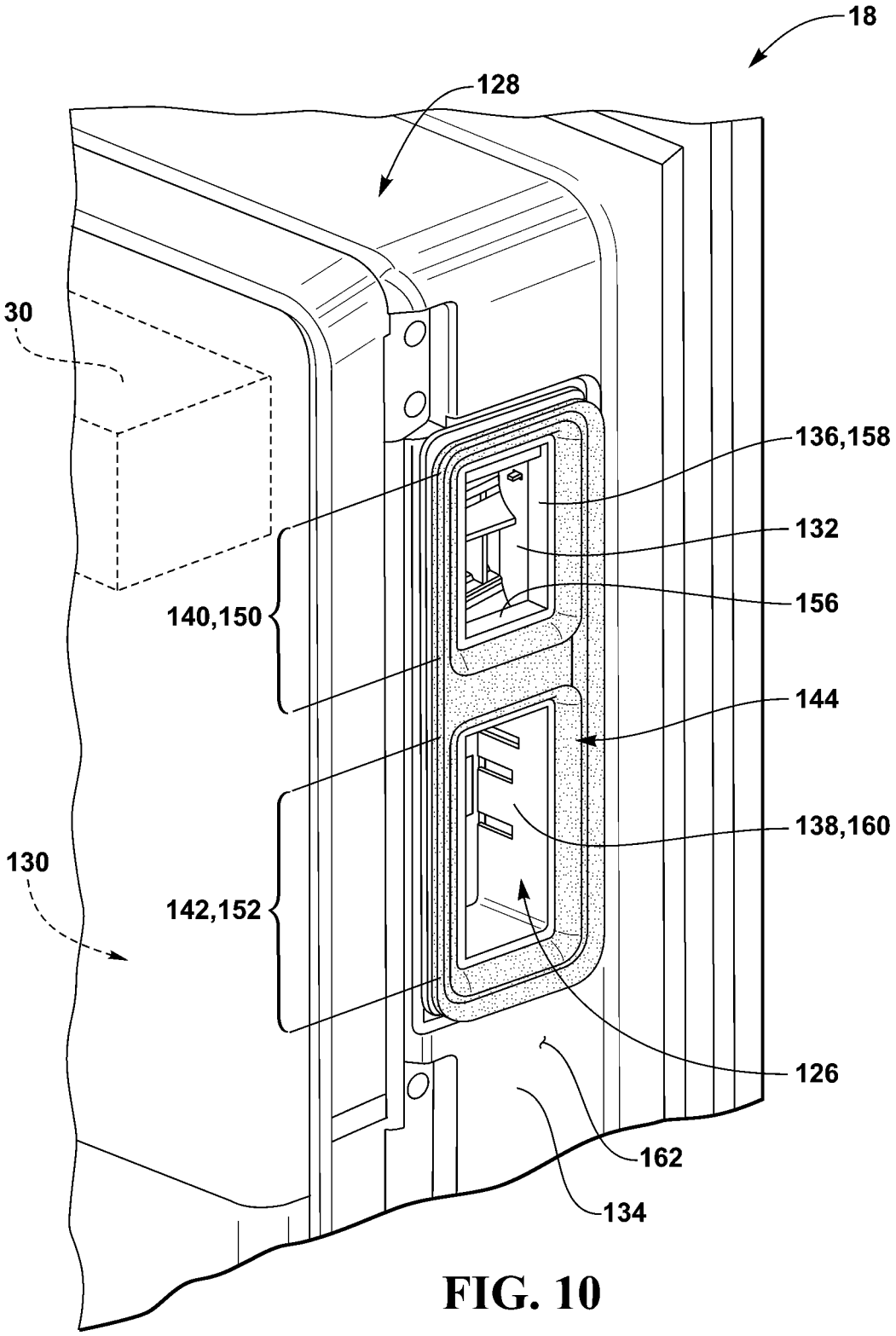
FIG. 10 is a partial isometric view of an internal side of a door of the refrigerator including the ice maker.
Figure 11:
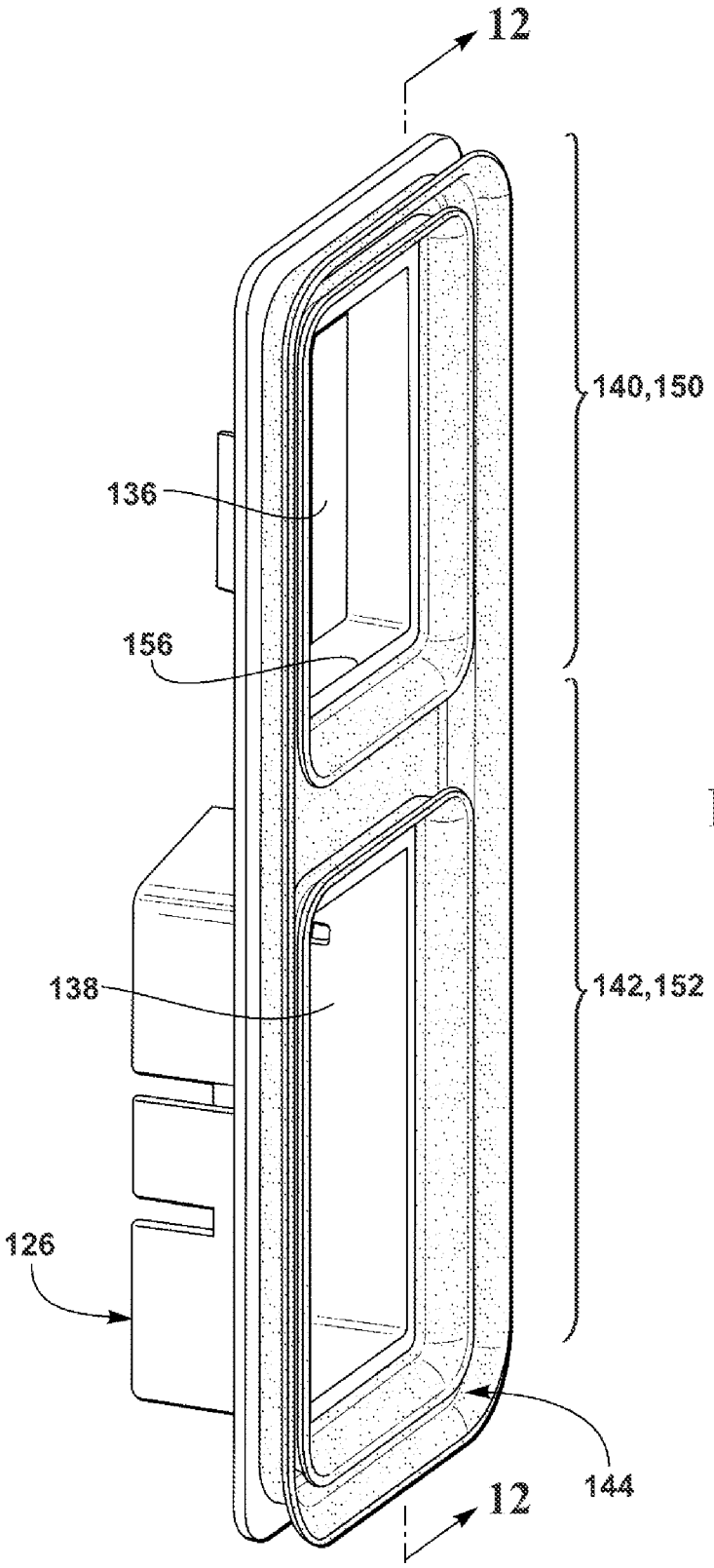
FIG. 11 is an isometric view of a secondary duct that is disposed on the door and is configured to channel air between duct assembly and the ice maker.
Figure 12:
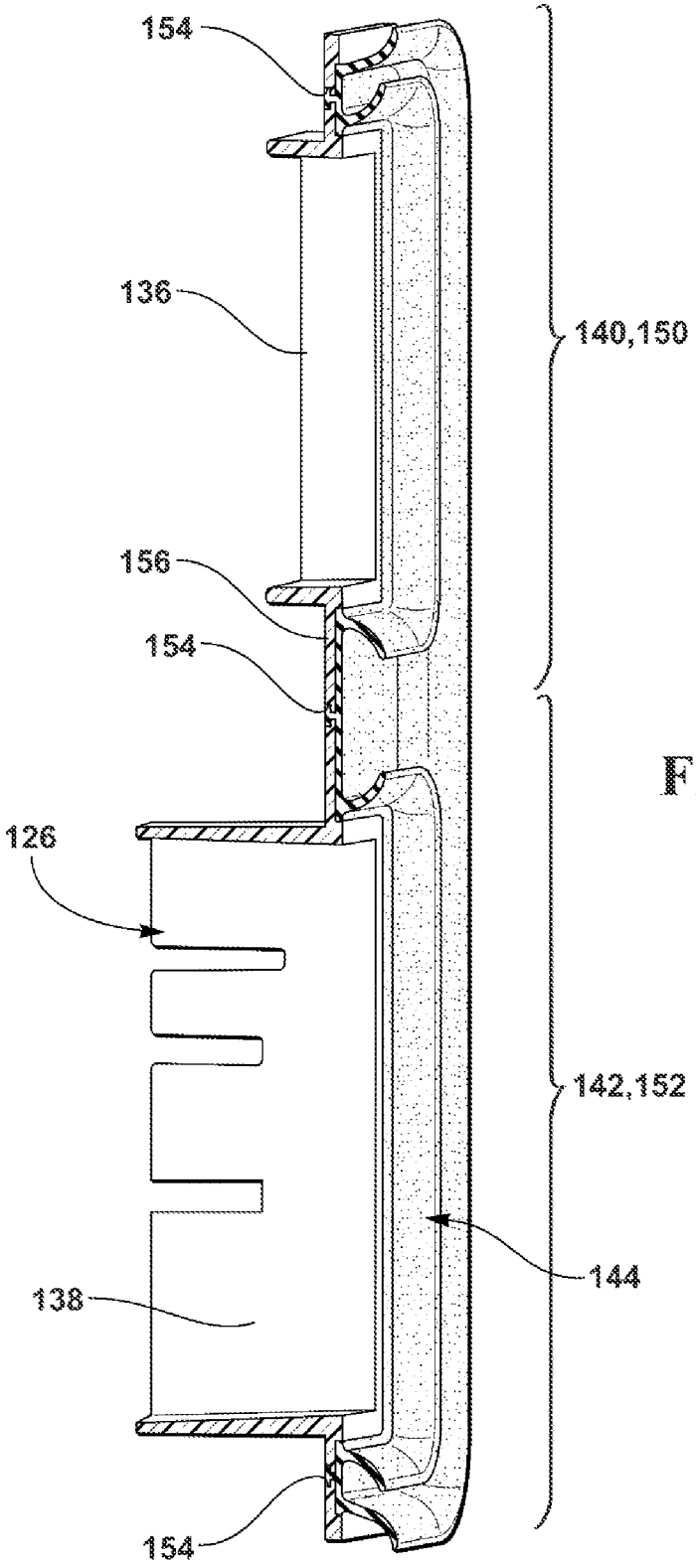
FIG. 12 is a cross-sectional view taken along line 12-12 in FIG. 11.

Referring now to FIG. 9, the evaporator housing 64 is shown with the evaporator plate 81 surrounding the evaporator 80 which opens into the spacing 103 disposed adjacent to the first side 100A of the first fan 100. In this way, the spacing 103 defines an airway from the evaporator 80 for cold air to fluidically connect with the first side 100A of the first fan 100 for intake and distribution into the freezer compartment 24, as powered by the first fan 100, and distribution into the ice maker 30, as powered by the first fan 100 alone or in combination with the second fan 102 in a manner as described above. As shown in FIG. 9, the second fan 102 includes a housing 122 that further includes a mounting flange 124. The housing 122 surrounds and insulates the second fan 102 from the spacing 103, such that the second fan 102 is not in direct fluid communication with the spacing 103 and the cold air from the evaporator 80. The mounting flange 124 of the housing 122 is configured to couple to the rear wall 40 (FIG. 1) of the exterior wrapper 32, or the evaporator housing cover 65 (FIG. 2).

Referring now to FIGS. 8 and 10-12, a secondary air duct 126 that is disposed on the door 18 and is configured to channel air between the duct assembly 70 and the ice maker 30 is illustrated. The secondary air duct 126 may also be referred to as the third air duct with respect to the ice maker feed duct 72 and ice maker return duct 82, which may be referred to as the first and second air ducts. The door 18 includes an inner liner 128. The inner liner 128 defines an internal space 130. The inner liner 128 also defines an orifice 132 providing access to the internal space 130. The ice maker 30 may be more specifically disposed within the internal space 130. The orifice 132 may more specifically be defined along an internal side panel 134 of the door 18. The internal side panel 134 may more specifically form a portion the inner liner 128. The secondary air duct 126 may more specifically be disposed within the orifice 132.

The secondary air duct 126 defines an inlet aperture or orifice 136 and an outlet aperture or orifice 138. The inlet orifice 136 is configured to establish fluid communication between the ice maker feed duct 72 and the ice maker 30. The outlet orifice 138 is configured to establish fluid communication between the ice maker return duct 82 and the ice maker 30. The inlet orifice 136 is also configured to establish fluid communication between the ice maker feed duct 72 and the internal space 130 where the ice maker 30 is disposed. The outlet orifice 138 is also configured to establish fluid communication between the ice maker return duct 82 and the internal space 130 where the ice maker 30 is disposed.

The secondary air duct 126 may be comprised of an inlet air duct 140 that defines the inlet orifice 136 and an outlet air duct 142 that defines the outlet orifice 138. The inlet air duct 140 may be said to establish fluid communication between the ice maker feed duct 72 and the ice maker 30 while the outlet air duct 142 may be said to establish fluid communication between the ice maker return duct 82 and the ice maker 30. The inlet air duct 140 is also configured to establish fluid communication between the ice maker feed duct 72 and the internal space 130 where the ice maker 30 is disposed. The outlet air duct 142 is also configured to establish fluid communication between the ice maker return duct 82 and the internal space 130 where the ice maker 30 is disposed. The inlet air duct 140 and the outlet air duct 142 may be formed as a single component (i.e., the secondary air duct 126). Fluid communication between the duct assembly 70 (including the ice maker feed duct 72 and the ice maker return duct 82) and the ice maker 30 (or the internal space 130) via the inlet air duct 140 and the outlet air duct 142 may be established when the door 18 is in the closed position (e.g., FIG. 8) but not when the door 18 is in an open position (e.g., FIG. 10).

A gasket 144 may be overmolded onto the secondary air duct 126. The gasket 144 is configured to from a seal (i) along an interface 146 between the inlet air duct 140 and the ice maker feed duct 72 and (ii) along an interface 148 between the outlet air duct 142 and the ice maker return duct 82. Stated in other terms, the gasket 144 is configured to from a seal along the interface between the secondary air duct 126 and the primary air ducts (i.e., the ice maker feed duct 72 and the ice maker return duct 82). The gasket 144 may more specifically be configured to form a seal (i) between the internal cavity 41 and the interface 146 between the inlet air duct 140 and the ice maker feed duct 72 and (ii) between the internal cavity 41 and the interface 148 between the outlet air duct 142 and the ice maker return duct 82. The gasket 144 may only be configured to form the seals when the door 18 is in the closed position (e.g., FIG. 8) but not when the door 18 is in an open position (e.g., FIG. 10).

The gasket 144 may be comprised of a first gasket 150 and a second gasket 152. The first gasket 150 is (i) overmolded onto the inlet air duct 140 and (ii) configured to from the seal between the internal cavity 41 and the interface 146 between the inlet air duct 140 and the ice maker feed duct 72. The second gasket 152 is (i) overmolded onto the outlet air duct 142 and (ii) configured to from the seal between the internal cavity 41 and the interface 148 between the outlet air duct 142 and the ice maker return duct 82. The first and second gaskets 150, 152 may be formed as a singled component (i.e., gasket 144).

The secondary air duct 126 may define t-slots 154. The gasket 144 may extend into the T-slots to anchor the gasket 144 to the secondary air duct 126. The secondary air duct 126 may include a cross-member 156 that separates the inlet orifice 136 and the outlet orifice 138. The gasket 144 may extend (i) over the cross-member 156, (ii) about or around an outer periphery 158 of the inlet orifice 136, and (iii) about or around an outer periphery 160 of the outlet orifice 138. The gasket 144 is disposed along an exterior surface 162 of the internal side panel 134 such that the gasket 144 faces outward from the inner liner 128.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator comprising:

a cabinet defining an internal cavity;

first and second air ducts disposed within the internal cavity;

a door (i) secured to the cabinet, (ii) having an ice maker disposed thereon, and (iii) inlet and outlet air ducts that are configured to establish fluid communication between the first and second air ducts and the ice maker, respectively, when the door is in a closed position, wherein (a) the inlet and outlet air ducts define T-slots, (b) the T-slots extend through the inlet and outlet ducts from exterior surfaces to interior surfaces of the inlet and outlet ducts, and (c) widths of the T-slots along the interior surfaces are larger relative to widths of the T-slots along the exterior surfaces;

a first gasket (i) overmolded onto the inlet air duct and (ii) configured to from a first seal between the internal cavity and an interface between first air duct and the inlet air duct; and a second gasket (i) overmolded onto the outlet air duct and (ii) configured to from a second seal between the internal cavity and an interface between second air duct and the outlet air duct, wherein the first and second gaskets extend from the exterior surfaces and into the T-slots.

2. The refrigerator of claim 1, wherein the inlet and outlet air ducts are formed as a single component.

3. The refrigerator of claim 2, wherein the first and second gaskets are formed as a single component.

4. The refrigerator of claim 2, wherein the inlet and outlet air ducts define inlet and outlet orifices that are separated by a cross-member.

5. The refrigerator of claim 4, wherein the first and second gaskets are formed as a single component the extends about outer peripheries of each of the inlet and outlet orifices.

6. The refrigerator of claim 5, wherein the single component forming the first and second gaskets extends (i) over the cross-member and (ii) from the inlet orifice to the outlet orifices along the cross-member.

7. The refrigerator of claim 1, wherein (i) the exterior surfaces of the inlet and outlet ducts define recessed regions and (ii) the first and second gaskets are disposed within the recessed regions.

8. A refrigerator comprising:

first and second air ducts;

a door (i) having an ice maker disposed thereon and (ii) a third air duct disposed along an internal side panel, wherein the third air duct (a) defines inlet and outlet orifices configured to establish fluid communication between first and second air ducts and the ice maker, respectively, and (b) includes a cross-member that separates the inlet and outlet orifices; and a gasket (i) overmolded onto the third air duct, (ii) extending about the outer peripheries of each of the inlet and outlet orifices, (iii) extending over the cross-member, (iv) extending from the inlet orifice to the outlet orifice along the cross-member, and (v) configured to from a seal along an interface between third air duct and first air duct and along an interface between third air duct and second air duct.

9. The refrigerator of claim 8, wherein the gasket is configured to form the seal when the door is in a closed position.

10. The refrigerator of claim 9, wherein the gasket is not configured to form the seal when the door is in an open position.

11. The refrigerator of claim 8, wherein (i) the third air duct defines at least one T-slot and (ii) the gasket extends into the at least one T-slot.

12. The refrigerator of claim 11, wherein (i) the at least one T-slot extends through the third air duct from an exterior surface to an interior surface of the third air duct, (ii) a width of the at least one T-slot along the interior surface is larger relative to a width of the at least one T-slot along the exterior surface, and (iii) the gasket extends from the exterior surface and into the at least one T-slot.

13. The refrigerator of claim 8, wherein the gasket is disposed along an exterior surface of the internal side panel.

14. The refrigerator of claim 8, wherein (i) an exterior surface of the third air duct defines a recessed region and (ii) the gasket is disposed within the recessed region.

15. A refrigerator comprising:

primary air ducts;

a door having an inner liner, the inner liner (i) defining an internal space and (ii) defining an orifice providing access to the internal space;

an ice maker disposed within the internal space;

a secondary air duct (i) disposed within the orifice, (ii) defining inlet and outlet apertures configured to establish fluid communication between the primary air ducts and the internal space, and (iii) having a cross-member that separates the inlet and outlet apertures; and a gasket (i) overmolded onto the secondary air duct, (ii) extending about outer peripheries of each of the inlet and outlet apertures, (iii) extending over the cross-member, (iv) extending from the inlet aperture to the outlet aperture along the cross-member, and (v) configured to from a seal along an interface between secondary air duct and the primary air ducts.

16. The refrigerator of claim 15, wherein the gasket is configured to form the seal when the door is in a closed position.

17. The refrigerator of claim 15, wherein the gasket is not configured to form the seal when the door is in an open position.

18. The refrigerator of claim 15, wherein (i) the secondary air duct defines at least one T-slot and (ii) the gasket extends into the at least one T-slot.

19. The refrigerator of claim 18, wherein (i) the at least one T-slot extends through the secondary air duct from an exterior surface to an interior surface of the secondary air duct, (ii) a width of the at least one T-slot along the interior surface is larger relative to a width of at least one T-slot along the exterior surface, and (iii) the gasket extends from the exterior surface and into the at least one T-slot.

20. The refrigerator of claim 15, wherein (i) an exterior surface of the secondary air duct defines a recessed region and (ii) the gasket is disposed within the recessed region.

* * * * *